US008696327B2

(12) United States Patent
Forsberg

(10) Patent No.: US 8,696,327 B2
(45) Date of Patent: Apr. 15, 2014

(54) SUBMERSIBLE PUMP MOTOR COOLING THROUGH EXTERNAL OIL CIRCULATION

(75) Inventor: Michael A. Forsberg, Claremore, OK (US)

(73) Assignee: Baker Hughes Incorporated, Houston, TX (US)

( * ) Notice: Subject to any disclaimer, the term of this patent is extended or adjusted under 35 U.S.C. 154(b) by 393 days.

(21) Appl. No.: 12/632,883

(22) Filed: Dec. 8, 2009

(65) Prior Publication Data

US 2010/0143160 A1 Jun. 10, 2010

Related U.S. Application Data

(60) Provisional application No. 61/120,743, filed on Dec. 8, 2008.

(51) Int. Cl.
*F04B 39/06* (2006.01)

(52) U.S. Cl.
USPC ..... 417/367; 417/368; 417/423.3; 417/423.8; 417/424.1; 310/64; 310/89; 310/90

(58) Field of Classification Search
USPC ..... 417/367, 423.8, 424.1, 423.3, 370, 368; 166/62, 68, 105; 175/107; 310/90, 89, 310/64, 54, 87
See application file for complete search history.

(56) References Cited

U.S. PATENT DOCUMENTS 2,107,481 A * 2/1938 Johnson ..... 417/367
2,556,435 A 6/1951 Moehrl et al.
2,598,547 A * 5/1952 Ivanoff ..... 417/372
2,913,988 A * 11/1959 White ..... 417/357
3,242,360 A 3/1966 Carle
3,671,786 A 6/1972 Jones
4,286,185 A 8/1981 Erickson
4,685,867 A 8/1987 Patun et al.
4,838,758 A 6/1989 Sheth
5,189,328 A 2/1993 Knox
5,203,682 A 4/1993 Inklebarger
5,297,943 A 3/1994 Martin
5,554,897 A 9/1996 Martin et al.
5,722,812 A 3/1998 Knox et al.

(Continued)

FOREIGN PATENT DOCUMENTS

JP 2008029099 A * 2/2008

OTHER PUBLICATIONS

PCT International Search Report and Written Opinion dated Jul. 8, 2010 for PCT Patent Application No. PCT/US2009/067167, 6 pages.

(Continued)

*Primary Examiner* — Charles Freay
*Assistant Examiner* — Joseph Herrmann
(74) *Attorney, Agent, or Firm* — Bracewell & Giuliani LLP

(57) ABSTRACT

An electrical submersible pump motor has motor oil flowing through external circulation tubes for cooling the motor. A substantial portion of the exterior of each tube is submerged in and exposed to wellbore fluid. Heat is transferred from the motor to the motor oil, and then circulated through the external circulation tubes to conduct heat to the wellbore fluid. Internal or external motor oil pumps may be used to propel the motor oil through the circulation tubes. Guards or baffles may be used to protect the circulation tubes and to influence the flow of production fluid over the circulation tubes.

8 Claims, 6 Drawing Sheets

(56) References Cited

U.S. PATENT DOCUMENTS

| | | | | |
|---|---|---|---|---|
| 5,828,149 | A | 10/1998 | Parmeter et al. | |
| 5,845,709 | A * | 12/1998 | Mack et al. | 166/302 |
| 5,898,245 | A | 4/1999 | Cochimin | |
| 5,988,996 | A | 11/1999 | Brookbank et al. | |
| 6,086,331 | A * | 7/2000 | Halkjær | 417/9 |
| 6,099,271 | A | 8/2000 | Brookbank | |
| 6,167,965 | B1 | 1/2001 | Bearden et al. | |
| 6,364,013 | B1 * | 4/2002 | Watson et al. | 166/105 |
| 6,557,905 | B2 | 5/2003 | Mack et al. | |
| 6,566,774 | B2 | 5/2003 | Parmeter et al. | |
| 6,666,269 | B1 * | 12/2003 | Bangash et al. | 166/310 |
| 6,691,782 | B2 * | 2/2004 | Vandevier | 166/265 |
| 6,752,560 | B2 | 6/2004 | Wilson et al. | |
| 6,956,310 | B1 | 10/2005 | Knox | |
| 6,969,940 | B2 | 11/2005 | Dalrymple et al. | |
| 7,009,317 | B2 | 3/2006 | Cronin et al. | |
| 7,161,456 | B2 | 1/2007 | Knox | |
| 7,174,001 | B2 | 2/2007 | Andrews et al. | |
| 7,492,069 | B2 | 2/2009 | Knox et al. | |
| 7,611,338 | B2 | 11/2009 | Swatek et al. | |
| 7,665,975 | B2 | 2/2010 | Parmeter et al. | |
| 7,708,534 | B2 | 5/2010 | Parmeter et al. | |
| 7,766,081 | B2 | 8/2010 | Brown et al. | |
| 8,037,936 | B2 | 10/2011 | Neuroth et al. | |
| 2009/0269224 | A1 * | 10/2009 | Hunt et al. | 417/423.3 |
| 2010/0150739 | A1 | 6/2010 | Brookbank et al. | |

OTHER PUBLICATIONS

One sheet from a brochure of Byron Jackson identified as Bulletin No. 2560-6A, brochure published in the 1990's (unknown specific date).

* cited by examiner

SUBMERSIBLE PUMP MOTOR COOLING THROUGH EXTERNAL OIL CIRCULATION

CROSS-REFERENCE TO RELATED APPLICATION

This application claims priority to provisional application 61/120,743, filed Dec. 8, 2008.

BACKGROUND OF THE INVENTION

1. Technical Field

This invention relates in general to well pumps, and in particular to a well pump housing using circulating oil to improve heat transfer.

2. Description of the Related Art

A electrical submersible pump ("ESP") is used to pump production fluid, such as crude oil, from the depths of the earth up to the surface. The ESP is usually located in a wellbore, frequently at great depths below the surface of the earth. The ESP has a pump, a motor to drive the pump, and a seal section with a shaft between the motor and the pump. The ESP motor tends to produce heat that must be removed to prolong the life of the motor.

External devices used to decrease heat create additional costs. External cooling devices, for example, use a coolant pump above grade and coolant lines running through the wellbore to the pump. These cooling devices cool the pump by circulating the coolant through the pump and transferring the coolant back to the surface. The pump, coolant lines, and coolant all create additional costs. Furthermore, the coolant lines may interfere with well operations. The motor-pump assembly is located inside a wellbore and generally submerged in production fluid inside the wellbore so it is desirable to transfer heat to the production fluid that is flowing past the motor.

It is common to arrange the pump and motor such that the production fluid flows past the motor on its way to the pump. Heat is transferred to the production fluid and carried away as the production fluid moves to the surface. Motor oil is used inside the pump motor to lubricate the parts of the motor. The motor oil becomes hot during normal operation as it absorbs heat from the moving parts. The heat from the motor oil, like the heat from the other components in the motor, must pass through the stator and through the motor housing to be radiated to the production fluid flowing past the motor in the wellbore. It is desirable to increase the rate of heat transfer from the motor to the production fluid.

SUMMARY OF THE INVENTION

Electrical submersible pumps ("ESP"), used to pump wellbore fluid from the depths of the earth up to the surface, generally have a pump, a motor, and a seal section located between the pump and the motor. Inside the motor, the rotor spins within the stator and generates a significant amount of heat. A lubricant, such as a dielectric motor oil, is located within the motor housing to lubricate the moving surfaces. The lubricant also serves to transfer heat within the motor. The lubricant absorbs heat from heat generating surfaces, such as surfaces experiencing friction, and from other hot spots within the motor. As the oil circulates, it carries the heat from the hot spots to other cooler areas, where the heat is transferred to the cooler areas. Heat may be transferred through the exterior housing of the motor to the wellbore fluid in which the motor is submerged.

To facilitate more rapid heat transfer from the motor oil to the surrounding wellbore fluid, circulation tubes may be located externally to the motor. Each circulation tube is in communication with interior passages within the motor, in at least two places, such that motor oil flows through the circulation tube. As the motor oil flows through the tube, it transfers heat to the tube, which in turn passes the heat to the wellbore fluid in which the motor and the tubes are submerged.

Any number of circulation tubes may be used. In some embodiments, the tubes are protected or partially protected by guard structures, such as fins, or shields. Fins may also be used as circulation tubes, wherein the motor oil passes through an internal bore within the fin. The ends of the circulation tubes may attach at each end of the motor, or both ends of each tube may be attached near each other. The circulation tubes may take a circuitous path along or around the motor, which may increase the surface area in contact with production fluid.

Various pumps may be used to facilitate oil circulation through the tubes. For example, an impeller type pump may be located within the motor housing, turned by the motor shaft, and used to propel motor oil through the tubes. Alternatively, an external pump may be mounted to the motor such as, for example, below the motor. The external pump may be powered by the motor or by its own electrical motor. In some embodiments, no pump is used at all. Rather, the circulation tubes attach near high or low pressure points of the motor and thus the oil flows through the circulation tubes without the aid of a pump.

The production fluid flow may be modified to increase heat transfer from the circulation tubes. A shroud may be used to draw production fluid along the exterior surface of the tubes. Alternatively, a portion of the production fluid may be discharged from the primary pump into recirculation baffles. The recirculation baffles cause the discharged production fluid to flow along the motor oil circulation tubes and thus increase heat transfer.

DETAILED DESCRIPTION

Figure 1:
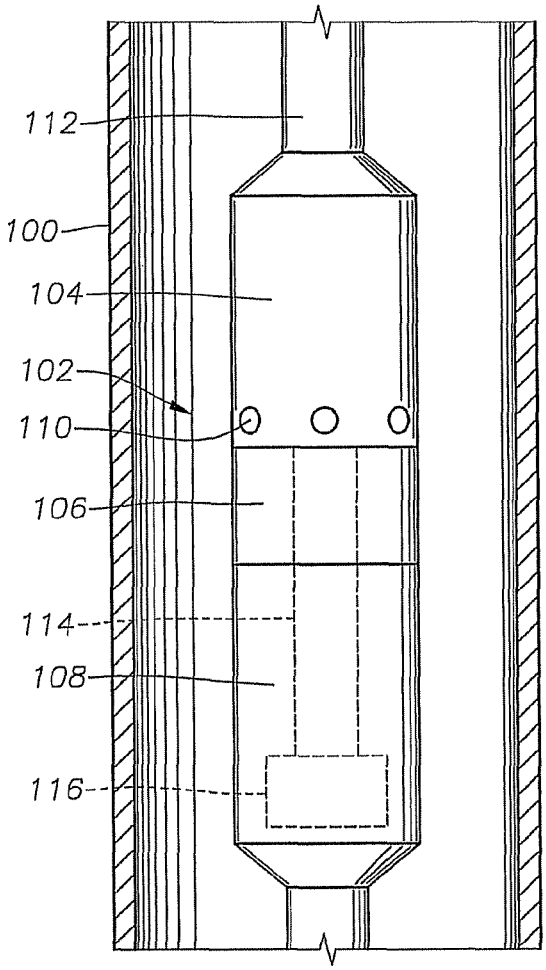
Fig. 1 (Prior Art)
FIG. 1 is a sectional view of a prior art pump assembly in a wellbore.

Referring to FIG. 1, a casing 100 is conventional casing used to line a wellbore. Casing 100 is shown in a vertical orientation, but could be inclined. An electrical submersible pump ("ESP") assembly 102, which includes pump 104, seal section 106, and motor 108, is suspended inside casing 100 and is used to pump fluid up from the well. ESP 102 is preferably submerged in production fluid within casing 100.

Pump 104 may be centrifugal or any other type of pump and may have an oil-water separator or a gas separator. Pump 104 is driven by a shaft (not shown) extending through seal section 106 and connected to motor 108. Preferably, the fluid produced by the well ("production fluid") flows past motor 108, enters an intake 110 of pump 104, and is pumped up through a tubing 112. Production fluid may include any wellbore fluids including, for example, crude oil, water, gas, liquids, other downhole fluids, or fluids such as water that may be injected into a rock formation for secondary recovery operations. Indeed, production fluid can include desired fluids produced from a well or by-product fluids that an operator desires to remove from a well. Preferably, motor 108 is located below the pump 104 in the wellbore. The production fluid may enter pump 104 at a point above motor 108, such that the fluid flows past the outside of the motor 108 and into the pump inlet 110.

Motor oil (not shown), located within motor 108, is used to lubricate moving parts such as the rotating shaft 114. Motor oil may be any type of dielectric fluid used to lubricate motor 108. Motor oil may circulate throughout motor 108 during operation and thus lubricate various components of motor 108. An oil reservoir 116 may hold a volume of oil and a pump (not shown) may be used to distribute oil within motor 108. Motor oil inside motor 108 may also absorb heat generated by the motor and thus transfer heat away from hot spots within motor 108.

Figure 2:
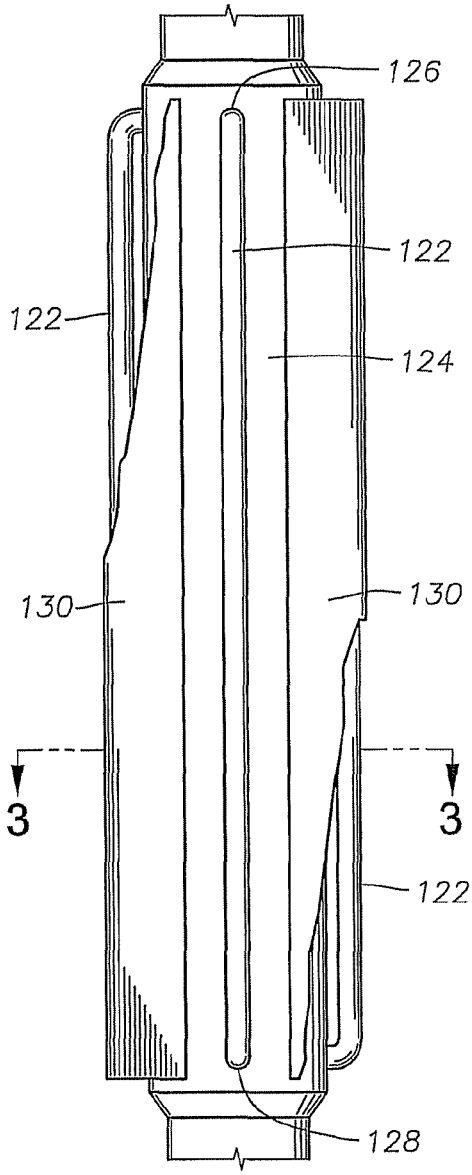
FIG. 2 is a side view of a pump motor with external oil circulation tubes; and protective fins.

Referring to FIG. 2, motor oil may circulate through circulation tubes 122 located on the exterior of pump motor 124. Each circulation tube 122 is a passage that is in fluid communication with interior portions of motor 124 in at least two locations. Circulation tubes 122 may attach to oil ports 126, 128 at any point on motor 124. Tubes 122 may, for example, attach to oil port 126 at the head of the motor 124, which is the end nearest the pump, and, for example, to oil port 128 at the base of motor 124. The circulation tubes 122 may connect to the oil ports 126, 128 by a variety of techniques, including, for example, pipe thread connections, welding, or quick disconnect fittings, and the like. Motor oil may circulate by, for example, entering each tube 122 at port 128, flowing up through tube 122, reentering motor 124 at port 126, and then passing through the interior of motor 124.

As the motor oil circulates through motor 124 and circulation tubes 122, the motor oil carries absorbed heat to circulation tubes 122. The exterior surfaces of circulation tubes 122 are submerged in and exposed to production fluid inside the wellbore. Thus heat is transferred from the circulating motor oil to circulation tubes 122 and then conducted through the surface of circulation tubes 122 and transferred to the production fluid. The production fluid carries the heat away as it is drawn past tubes 122, into intake 110 (FIG. 1), and subsequently pumped to the surface. The motor oil may flow through circulation tubes 122 from the head towards the base, or from the base towards the head.

Figure 3:
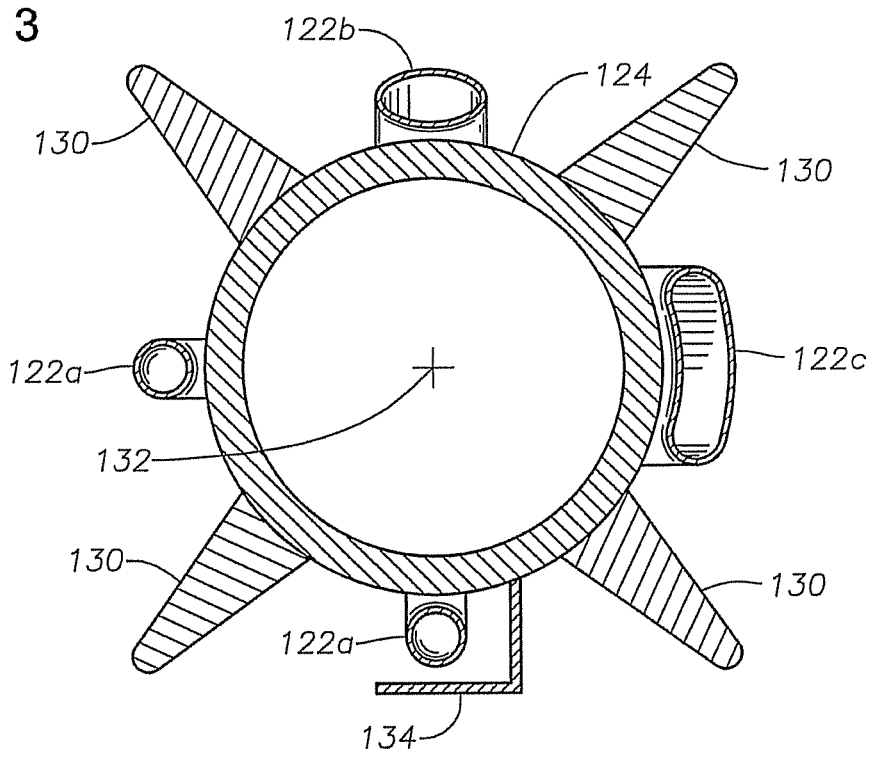
FIG. 3 is a cross-sectional view of the pump motor of FIG. 2 taken along the line 3-3 of FIG. 2.

Circulation tubes 122 may be any diameter, limited only by the viscosity of the motor oil and the size of the wellbore. The diameter must be large enough for the motor oil to flow through the tube, and must be small enough that the motor, with tubes attached, may fit inside the wellbore. There may be any number of tubes on the exterior of the motor 124. There may be, for example, just one tube 122 or there may be multiple tubes. In one embodiment, four tubes 122 are located axially around the pump motor 124. The tubes may be spaced equidistantly around the pump axis, as shown in FIG. 3, or they may have asymmetric spacing around pump axis 132. In some embodiments, circulation tubes 122 may extend axially past one or both ends of the pump motor 124.

Circulation tubes 122 may, in some embodiments, take a circuitous path (not shown) from one end of pump motor 124 to the other. Each tube 122 could, for example, connect at the head of the motor, run from the head towards the base, then back to towards the head, and finally back to the base where the flowpath connects to the motor. In other embodiments, the circulation tubes could, for example, rotate helically (not shown) around motor 124. Other variations of the circuitous path may be used including, for example, a circulation tube in an S-shape (not shown) or in a generally corrugated shape.

Circulation tubes 122 may have various lengths, shapes, and distances from motor 124 depending on design requirements. A motor 124 that, for example, tends to produce more heat may require a longer length of circulation tubing 122 to provide more surface area and a larger volume of oil for heat transfer. An application in a narrow wellbore, for example, may require small diameter tubes 122 that are located close to the motor 124 to facilitate easier movement of the pump assembly within the wellbore.

Referring to FIG. 3, circulation tubes 122 may have any cross sectional shape including, for example, round 122*a*, elliptical 122*b*, or a contoured shape 122*c* wherein interior surface (closest to motor 124) has a profile similar to the exterior of motor 124 and the outer surface has an arc-shaped profile having a radius slightly larger than the radius of motor 124.

One or more protective members, such as guard structures 130, may be used to protect circulation tubes 122. The guard structures 130 may extend axially along the length of the ESP assembly for a substantial portion of the length of the circulation tubes 122, the substantial distance being at least greater than half of the axial length of the circulation tube 122, as shown in FIG. 2. In are exemplary embodiment, guard structures 130 extend radially further from pump axis 132 than circulation tubes 122 and thus protect circulation tubes 122, as shown in FIG. 3. Guard structures 130 may prevent external objects, including the wellbore, from contacting circulation tubes 122. Alternatively, the outer edge of the guard structures 130 may be flush with the outer edge of the circulation tubes 122. Ire some embodiments, circulation tubes 122 could extend further from the pump axis than guard structures 130, in which case the guard structure 130 may still protect circulation tubes 122 against critical failure. In some embodiments, guard structures 130 are fins, but guard structures 130 may be any shape including, for example, rods, angle iron, I-beams, etc.

Furthermore, protective members may form a shield 134, wherein shield 134 wraps around all or part of the outermost portion of the circulation tube 122. Shield 134 may protect circulation tubes 122. Protective members 130, 134 may be made of metal or other heat conducting material and thus may also increase the rate of heat transfer by increasing the surface area of the pump motor 124.

Figure 4:
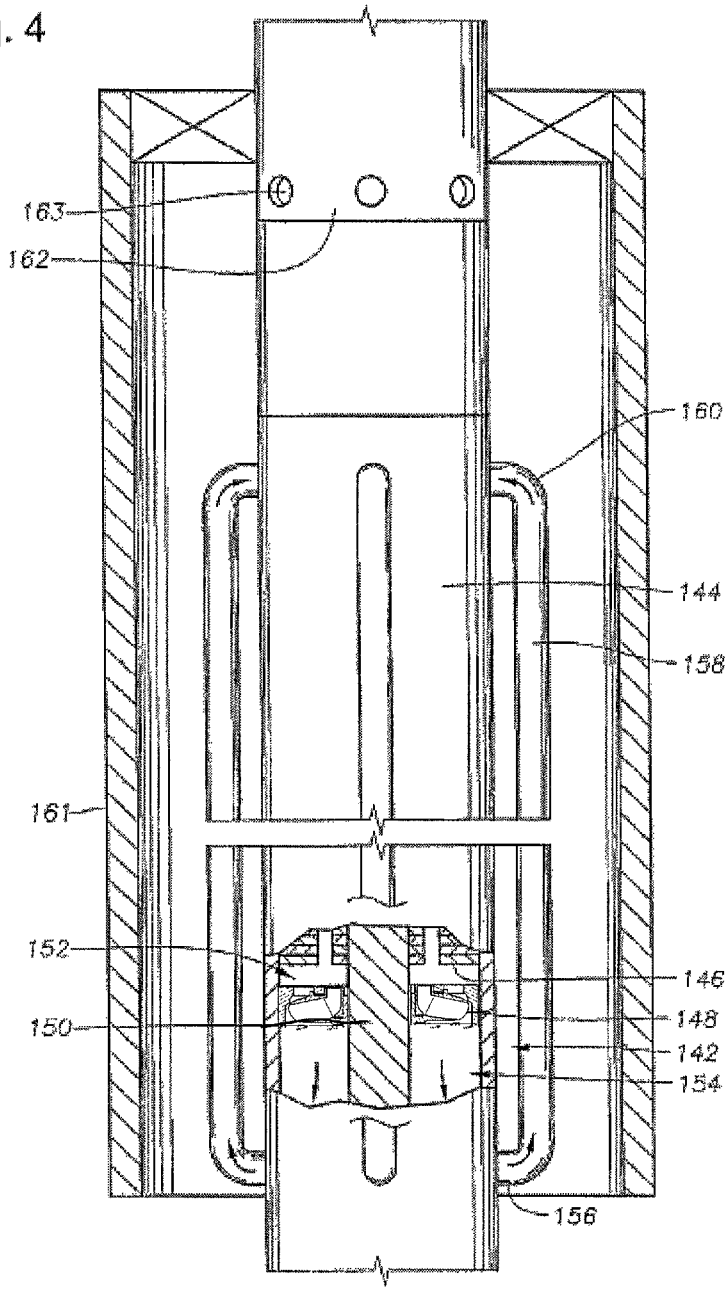
FIG. 4 is a sectional view of the pump motor of FIG. 2, showing an internal boost pump.

Referring to FIG. 4, boost pump 142 may be used to force the motor oil through the circulation tubes 158. Boost pump 142 may be located within the head or the base of motor 144 (as shown in FIG. 4) or may be located in seal section 106 (FIG. 1) and may use positive or negative pressure to improve oil circulation.

In one embodiment, boost pump 142 is located below stator windings 146. Pump stage impeller 148, which rotates on shaft 150, draws motor oil from a low pressure region 152 and discharges it into high pressure region 154. The higher pressure oil is pushed through oil port 156, up through circulation tube 158, to oil port 160. At oil port 160, the oil reenters the body of motor 144.

In alternative embodiments (not shown), boost pump 142 could be located above the stator windings. The impeller or impellers could be reversed such that the high pressure side 154 could be above impellers 148 and the low pressure side 152 could be below impellers 148. In still other embodiments, boost pump 142 could have a motor that is separate from pump motor 144. Different type of boost pump, (centrifugal or diaphragm for example) may be used and the high pressure 154 and low pressure 152 could be in any orientation or location in relation to the pump motor 144.

In embodiments where pump motor 144 develops high and low pressure regions of motor oil within the pump motor housing, without necessarily using booster pumps, circulation tubes 158 may tap into these regions and use the existing high and low pressure points to induce motor oil circulation through circulation tubes 158. Convection may also be used to propel oil through circulation tubes 158.

Still referring to FIG. 4, oil circulation tubes 158 may be used in conjunction with a shroud 161 that encircles the pump motor 144. Shroud 161 may have an open lower end and an upper end sealed to pump 162 above intake 163. Shroud 161 may be used to increase the heat-conducting surface area of pump 162 or motor 144, or it may be used to increase the velocity of the production fluid flowing between shroud 161 and pump motor 144. Circulation tubes 158 may or may not contact shroud 161. Shroud 161 may be used with any of the various embodiments of oil circulation tubes described herein.

Figure 6:
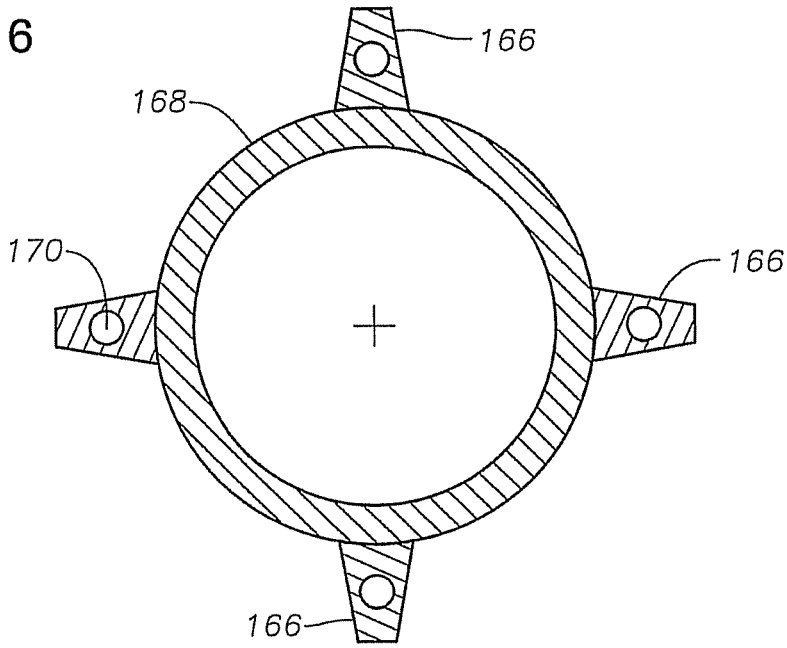
FIG. 6 is a cross-sectional view of the pump motor and external oil circulation tubes of FIG. 5, taken along the line 6-6 of FIG. 5.
Figure 5:
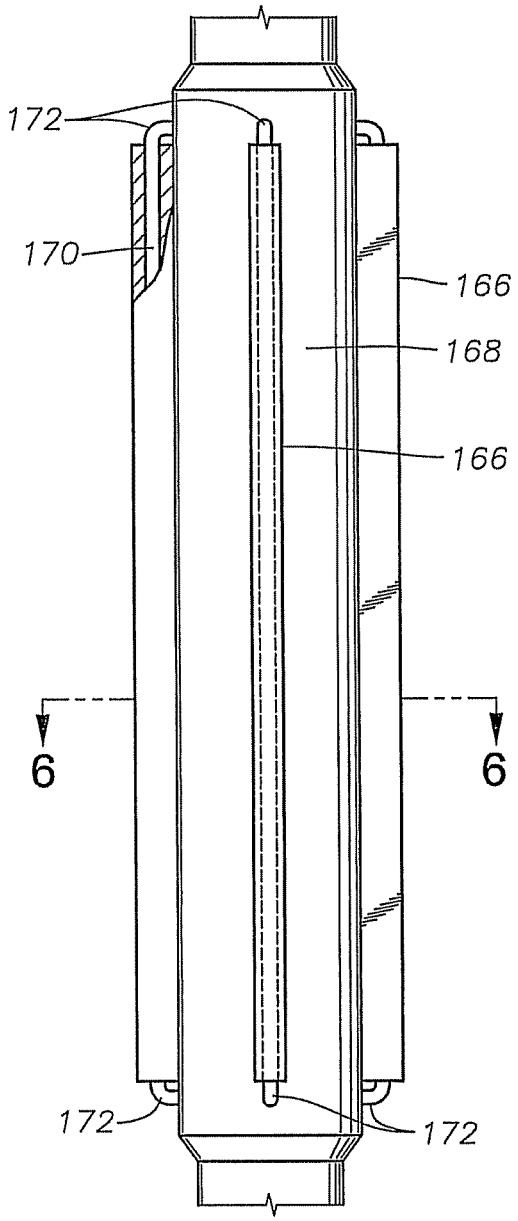
FIG. 5 is a side view of an alternative embodiment of external oil circulation tubes, showing a pump motor with external oil circulation passages located inside fins.

Referring to FIGS. 5 and 6, a hollow fin 166 may be used as the circulation tube. Fin 166 has a base abutting motor 168 housing and extending to a crest. The crest of the fin 166 may be more narrow than the base, or the sides of the fin may be parallel. In some embodiments, the crest is rounded, but may also be square, angular, or any other shape. Motor oil passes through an internal flowpath 170 within fin 166. Hollow fin 166 may be in direct communication with the oil ports on pump motor 166, or a circulation tube may pass through the hollow fin. Hollow fins 166 may be connected by, for example, an elbow-shaped connecting tube 172.

Any number of hollow fins 166 may be used, including a single hollow fin. In an exemplary embodiment, four hollow fins 166 are equidistantly spaced axially around pump motor 168. Hollow fins 166 may, however, by asymmetrically placed about pump motor 168. Hollow fins 166 may be used in conjunction with circulation tubes 122 (FIG. 3), in which case the hollow fins may also act as a guard structure for the tubes.

Figure 7:
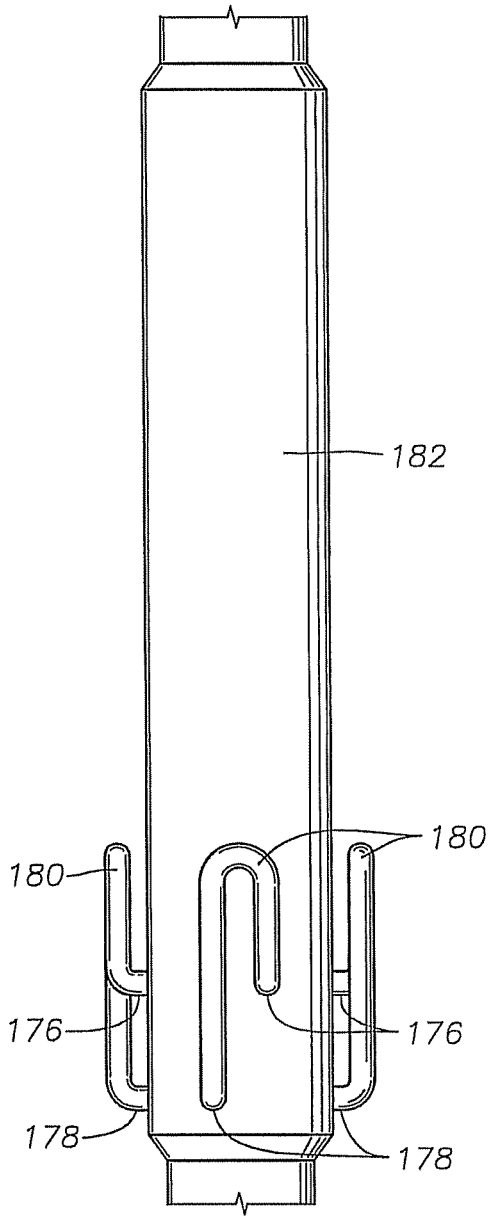
FIG. 7 is a side view of another embodiment of external oil circulation tubes, showing a pump motor with oil circulation tubes using a bottom inlet/outlet configuration.

Referring to FIG. 7, all of the inlet ports 176 and outlet ports 178 of circulation tube 180 may be located near one end of the pump motor 182. FIG. 7 depicts inlets 176 and outlets 178 all located near the bottom of the pump motor 182. Alternatively, inlets 176 and outlets 178 may all be, for example, located near the top of the pump motor 182. Inlets 176 and outlets 178 may be located anywhere on the pump motor 182, and the inlets 176 may be above, below, or adjacent to the outlets 178.

Figure 8:
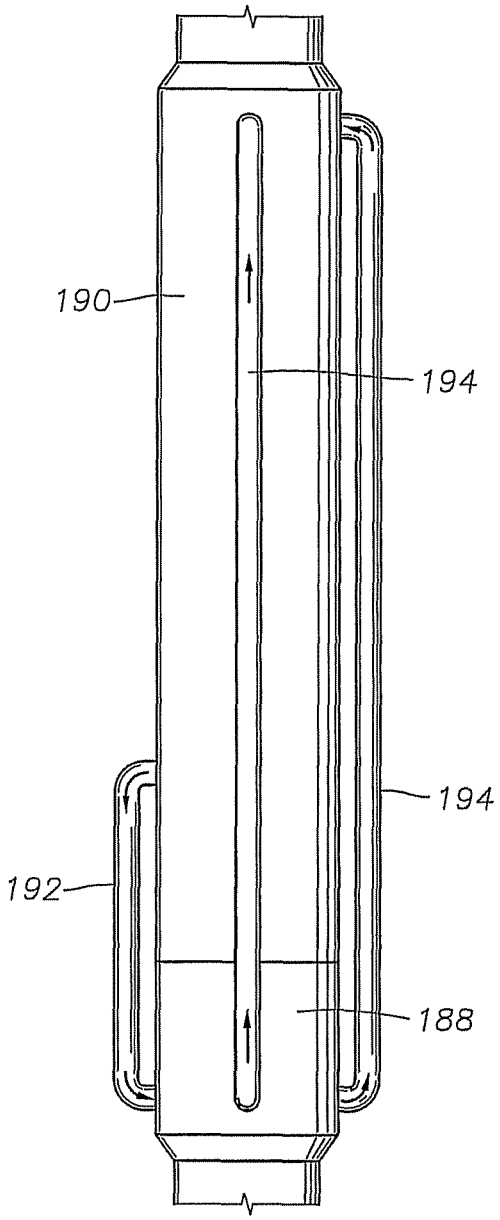
FIG. 8 is a side view of another alternative embodiment of external oil circulation tubes, showing a pump motor with an external boost pump and oil circulation tubes.

Referring to FIG. 8, external boost pump 188 may be located outside of pump motor 190. External boost pump 188 may be mechanically powered by motor 190, such as by the shaft of motor 190 (not shown) or by a power take off mechanism (not shown) that is rotated by the shaft of motor 190. Alternatively, external boost pump 188 may have its own electric motor (not shown). For embodiments having an electric motor (not shown) within boost pump 188, the electric motor (not shown) may be powered by a power cable (not shown) from motor 190 or by a separate power cable (not shown) that descends through the wellbore.

One or more inlet lines 192 may communicate motor oil from motor 190 to boost pump 188. One or more outlet lines 194 may flow oil from boost pump 188 back to motor 190. In some embodiments, a outlet line 194 may connect external pump 188 to a manifold (not shown). The manifold (not shown) may be used to distribute motor oil to a plurality of additional cooling lines, each of which then lead back into motor 190.

Figure 9:
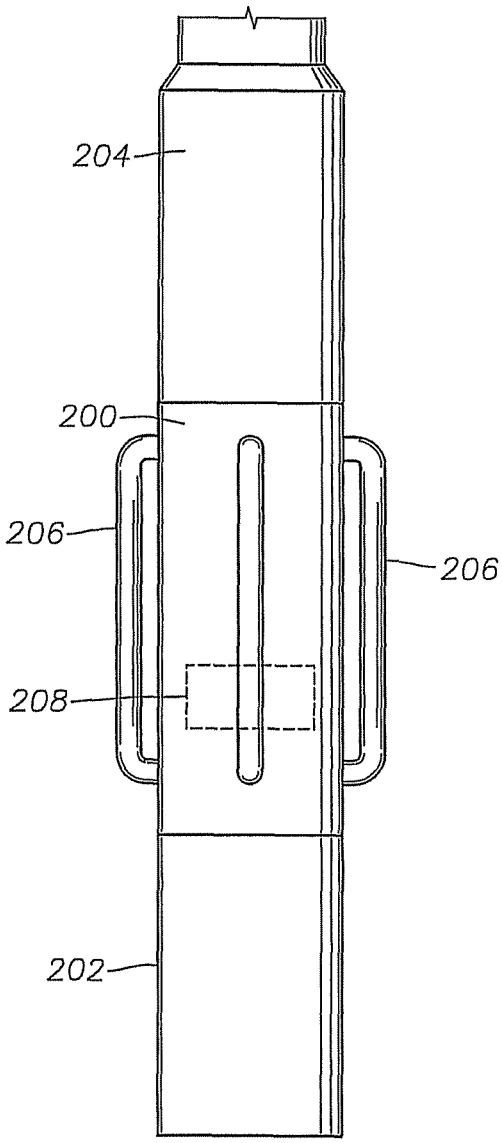
FIG. 9 is a side view of yet another embodiment of external oil circulation tubes, showing external oil circulation tubes connected to the seal section.

Referring to FIG. 9, in another alternative embodiment, seal section 200 is located between motor 202 and pump 204 (as is typical of all embodiments described herein). Motor oil may circulate internally between motor 202 and seal section 200 to cool and lubricate both motor 202 and seal section 204. Seal circulation tubes 206 may be located on the exterior of seal section 200 and be in fluid communication with internal motor oil passages within seal section 200. The exterior surface of seal circulation tubes 206 is thus in contact with the wellbore fluid in which seal section 200 is submerged. Thus motor oil may transfer heat to the wellbore fluid as it moves from motor 202 to seal section 200 and finally through seal circulation tubes 206. Any technique may be used to propel motor oil through circulation tubes, including, for example, convection, pressure points within seal section 200, or circulation pump 208. In some embodiments, circulation tubes may communicate motor oil between seal section 200 and motor 202.

Figure 11:
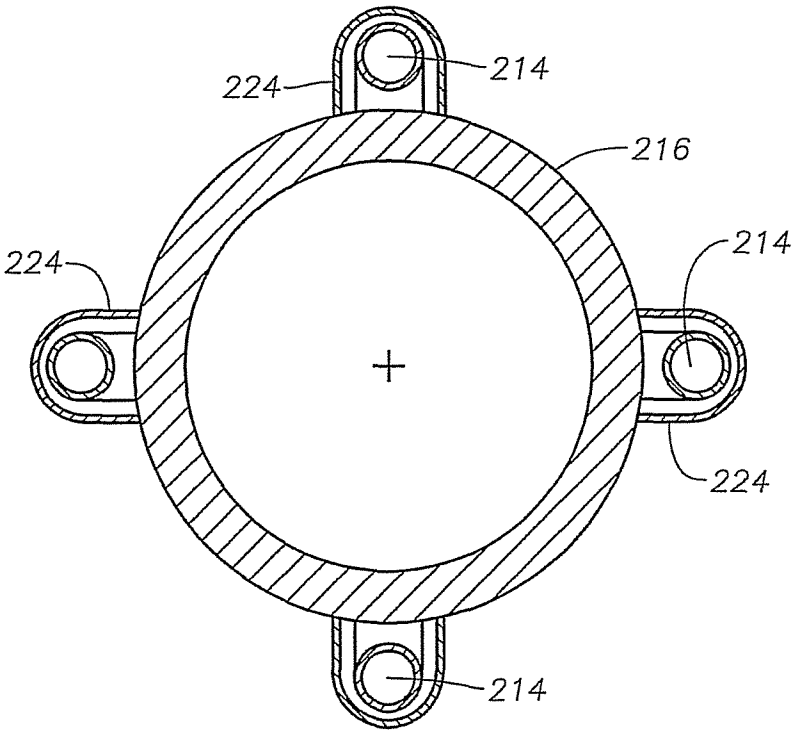
FIG. 11 is a cross-sectional view of the external oil circulation tubes of FIG. 10, taken along the line 11-11 line.
Figure 10:
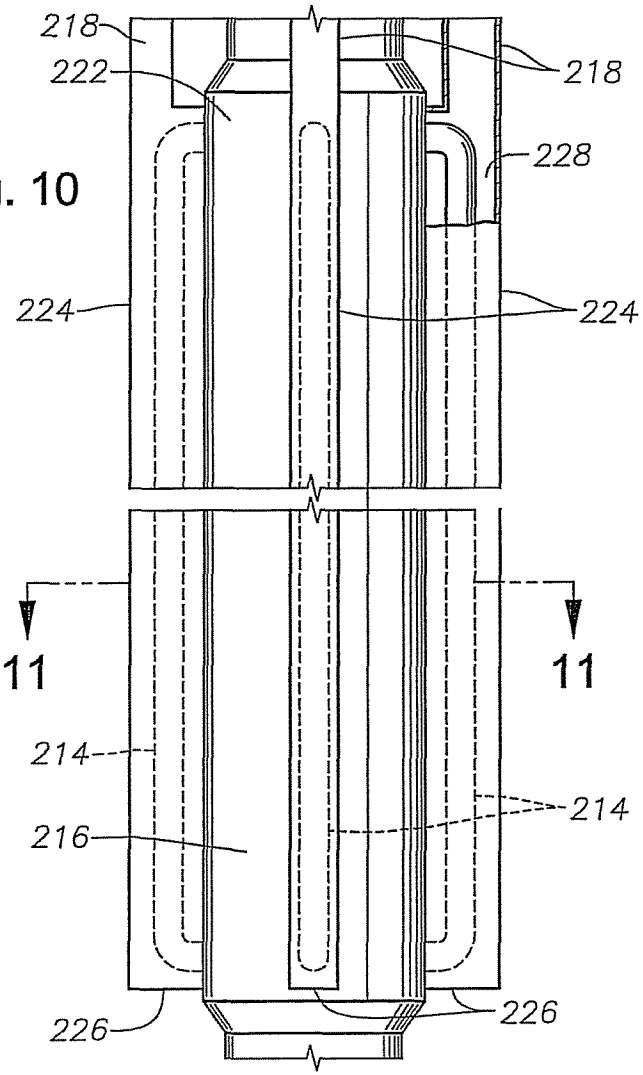
FIG. 10 is a side view of yet another embodiment of external oil circulation tubes, showing external oil circulation tubes and production fluid recirculation baffles.

Referring to FIGS. 10 and 11, recirculation tubing 214 is tubing in fluid communication with the interior of pump motor 216, similar to recirculation tubing 122 or its alternative embodiments described above. Production discharge tubes 218 are passages attached to and in fluid communication a discharge port (not shown) of pump 222. Production discharge tubes 218 may extend axially along a portion of the exterior of pump 222 to discharge baffles 224. Discharge baffles 224 may be passages that extend axially along the exterior of pump motor 216 for conveying production fluid. Discharge baffle exit 226 may be located near the base of motor 216. Each recirculation tube 214 is coaxially located within a discharge baffle 224. A gap 228 is formed between the exterior surface of recirculation tubing 214 and the interior surface of discharge baffle 224.

In operation, motor oil circulates through recirculation tubing 214. Pump 216 draws production fluid in and discharges a portion of production fluid through production discharge tubes 218. Production fluid passes through production discharge tubes 218 to discharge baffles 224. As production fluid flows through discharge baffles 224, it is in contact with the exterior of circulation tubes 214. Heat is transferred from circulation tubes 214 to the production fluid. The production fluid may then exit baffles 224 at discharge 226. The high velocity of production fluid in contact with recirculation tubing 214 may create a more rapid heat transfer than would occur in relatively static production. In some embodiments, the production fluid is routed from the baffle back to the pump or up to the production tubing.

Any number of circulation tubes 214, recirculation baffles 224, and production discharge tubes 218 may be used and may be arranged in any manner around the motor 216 and pump 222. The circulation tubes 214 could be, for example, hollow fins within the baffles.

While the invention has been shown or described in only some of its forms, it should be apparent to those skilled in the art that it is not so limited, but is susceptible to various changes without departing from the scope of the invention.

I claim:

1. An apparatus for pumping production fluid from a well, the apparatus comprising:

a submersible pump having an inlet;

a motor assembly coupled to the submersible pump for submersion in the production fluid, the motor assembly having a housing with a cylindrical side wall having an exterior surface and an interior chamber containing a stator, the motor assembly having a longitudinal axis, and a volume of lubricant being located in the interior chamber;

a shaft connecting the motor assembly and submersible pump, so that when the motor assembly rotates the shaft to drive the submersible pump, the production fluid enters the inlet and is pumped to the surface;

a plurality of circulating tubes, each of the circulating tubes having a first end, a second end, and an intermediate portion, where the first end is coupled to a first port that extends through the cylindrical side wall of the housing adjacent one end of the housing, and the first end is in fluid communication with the lubricant in the interior chamber, where the second end is coupled to a second port that extends through the cylindrical side wall of the housing adjacent an opposite end of the housing, and the second end is in fluid communication with the lubricant in the interior chamber, and where the intermediate portion joins the first end and the second end and extends alongside and at a distance radially outward from the cylindrical side wall of the housing and is in fluid communication with the lubricant in the interior chamber, the plurality of circulation tubes are located such that they are immersed in the production fluid from the well; and a plurality of guard structures, each of the guard structures is attached to and extends alongside the exterior surface of the cylindrical side wall of the housing of the motor assembly between adjacent ones of the plurality of circulating tubes, each of the guard structures protrudes radially outward from the housing of the motor assembly a distance that is greater than the radially outward distance of the intermediate portion of each of the circulating tubes, and the guard structure extends axially between the first end and the second end for a substantial length of the intermediate portion of each of the circulating tubes.

2. The apparatus according to claim 1, further comprising a booster pump connected to and driven by the motor assembly for propelling the lubricant through the plurality of circulating tubes.

3. The apparatus according to claim 1, wherein the first port is located below the stator of the motor assembly and the second port is located above the stator of the motor assembly.

4. The apparatus according to claim 1, wherein:

the plurality of guard structures extends from the first end to the second end of each of the plurality of circulating tubes.

5. A method for pumping fluid from a wellbore, the method comprising:

(a) providing a pump coupled to a motor assembly, the motor assembly having a housing with a cylindrical side wall, the motor assembly having a longitudinal axis, a chamber in the housing, a stator in the chamber, a lubricant in the chamber, and a plurality of circulating tubes, each of the circulating tubes having a first end extending through a first port in the cylindrical side wall adjacent one end of the housing in fluid communication with the lubricant in the chamber, a second end extending through a second port in the cylindrical side wall adjacent an opposite end of the housing in fluid communication with the lubricant in the chamber, and an intermediate portion joining the first and second ends and extending alongside the exterior surface of the cylindrical side wall of the housing radially outward from the stator;

(b) providing the motor assembly with a plurality of guard structures, each of the guard structures attached to and extending alongside the exterior surface of the cylindrical side wall of the housing of the motor assembly between adjacent ones of the circulating tubes, each of the guard structures protruding radially outward from the housing of the motor assembly a greater distance than the intermediate portion of each of the circulating tubes, and extending axially for a substantial length of the intermediate portion of each of the circulating tubes between the first and second ends;

(c) lowering the pump and the motor assembly into the wellbore and submerging the pump and the motor assembly in the production fluid; and (d) operating the motor assembly and circulating the lubricant through the plurality of circulating tubes so that the lubricant flows outside of the housing and within the plurality of circulating tubes and heat is transferred between the lubricant and the production fluid across a wall of each of the circulating tubes.

6. The method according to claim 5, wherein the step of operating the motor assembly and circulating the lubricant through the plurality of circulating tubes comprises propelling the lubricant through the plurality of circulating tubes with a booster pump.

7. The method according to claim 5, wherein step (a) comprises placing the first port below the stator and the second port above the stator.

8. An apparatus for pumping fluid from a well, the apparatus comprising:

a submersible pump having an inlet for drawing production fluid from the well;

a motor assembly coupled to and submersible with the submersible pump, the motor assembly having a housing with a cylindrical side wall having an exterior surface, a longitudinal axis, a chamber, a stator in the chamber, and a volume of lubricant being located in the chamber;

a plurality of circulating tubes, each of the circulating tubes having a first end joining a first port that extends through the cylindrical side wall below the stator in fluid communication with the volume of lubricant and a second end joining a second port that extends through the cylindrical side wall above the stator in fluid communication with the volume of lubricant, each of the circulating tubes extending alongside and exterior of the exterior surface of the cylindrical side wall of the housing of the motor assembly;

a plurality of guard structures, each of the respective guard structures is attached to and extends alongside the exterior surface of the cylindrical side wall of the housing of the motor assembly between adjacent ones of the plurality of circulating tubes, each of the respective guard structures protruding radially outward from the housing of the motor assembly a greater distance than each of the circulating tubes, and extending axially for a distance at least equal to a length of each of the circulating tubes; and a booster pump mounted to the motor assembly in fluid communication with the lubricant, where the booster pump is such that it forces the lubricant from the chamber, through the plurality of circulating tubes, and back to the chamber.

* * * * *

UNITED STATES PATENT AND TRADEMARK OFFICE

CERTIFICATE OF CORRECTION

PATENT NO. : 8,696,327 B2
APPLICATION NO. : 12/632883
DATED : April 15, 2014
INVENTOR(S) : Michael A. Forsberg It is certified that error appears in the above-identified patent and that said Letters Patent is hereby corrected as shown below:

In the Specification

Column 4, line 54, delete “Ire” and insert --In--
Column 5, line 21, delete “type” and insert --types--
Column 6, line 18, delete “a” and insert --an-- before “outlet”
Column 6, line 46, insert --with-- before “a discharge”

Signed and Sealed this
Second Day of September, 2014

Michelle K. Lee

Michelle K. Lee
*Deputy Director of the United States Patent and Trademark Office*